US005237380A

United States Patent [19]

Iimori

[11] Patent Number: 5,237,380

[45] Date of Patent: Aug. 17, 1993

[54] IMAGE FORMING APPARATUS

[75] Inventor: Akiro Iimori, Kanagawa, Japan

[73] Assignee: Kabushiki Kaisha Toshiba, Kawasaki, Japan

[21] Appl. No.: 676,375

[22] Filed: Mar. 28, 1991

[30] Foreign Application Priority Data

Mar. 30, 1990 [JP] Japan ..... 2-084718

[51] Int. Cl.[5] ..... G03G 21/00

[52] U.S. Cl. ..... 355/320; 355/208

[58] Field of Search ..... 355/308, 309, 318, 320, 355/208; 271/3, 3.1, 256

[56] References Cited

U.S. PATENT DOCUMENTS

| | | | |
|---|---|---|---|
| 4,315,685 | 2/1982 | Inuzuka et al. | 355/208 |
| 4,497,568 | 2/1985 | Komiya et al. | 355/208 |
| 4,977,428 | 12/1990 | Sakakura et al. | 355/245 |
| 5,028,965 | 7/1991 | Kinoshito et al. | 355/308 X |

*Primary Examiner*—Leo P. Picard

*Assistant Examiner*—Christopher Horgan

*Attorney, Agent, or Firm*—Foley & Lardner

[57] ABSTRACT

An image forming apparatus includes an image forming unit for successively forming an image on each of image forming media respectively corresponding to a first image of a first document and a second image of a second document. The image forming unit of the apparatus idles between the end of the first image forming operation for the first document and the commencement of the second image forming operation for the second document. The apparatus further includes a platen glass for supporting each of the documents, an automatic document feeder for successively setting the first document and the second document onto the platen glass, a detector for detecting an operating condition which the automatic document feeder actuates to set the documents onto the platen glass, and a controller for prohibiting the idling of the operation of the image forming unit when the detector detects the operating condition.

15 Claims, 8 Drawing Sheets

IMAGE FORMING APPARATUS

BACKGROUND OF THE INVENTION

1. Field of the Invention

The present invention relates to an image forming apparatus in which an accessory unit is mounted to the main body for promoting the image forming operation.

2. Description of the Related Art

Image forming apparatuses, constituted by copiers, are able to copy both sides, of a single document onto both sides of a paper P. These have improved in reliability in recent years, and their cost has come down as a result, their use is increasing.

FIG. 7 shows a diagrammatic cross-sectional view of a copier provided with a paper feed unit or an Automatic Duplex Device 1 (hereinbelow abbreviated as ADD) for two-sided copying, and a Reversible Automatic Document Feeder (hereinbelow abbreviated as RADF) of the both-sides paper-feed type. FIG. 8 shows a time chart of the copying process.

Both-sides copying operation is commenced by pressing a both-sides copy mode key (not shown), and a print key (not shown). First, an ADD main motor (not shown) is rotated, causing changeover gate 9 to change over to the direction of stacker 3 in which sheets of paper P are stored. At the same time, paper side guide 5 and paper rear end guide 7 of stacker 3 are moved by a driving means (described later) into positions corresponding to the selected paper size.

Next, paper P extracted by paper feed roller 13 from paper tray 11 is fed to photosensitive body 21 of image forming unit 19 by means of feed roll 15 and aligning roll 17. Copying of the first side of paper P is then performed as follows. Toner is transferred from photosensitive body 21 by means of transfer charger 23. The paper is then separated from photosensitive body 21 by the action of separating charger 25 (process A), and fed to fixing unit 29 by conveyor belt 27, thus completing the copying of the first side. After this, paper P is discharged by discharge roll 31 and fed into stack feed path 33 of ADD 1 by means of changeover gate 9 (process B). After completion of process A, the document is turned over by the RADF, to prepare for the copying of the second side of the paper.

Paper P in stack feed path 33 is fed to stacker 3 by conveyor rolls 35, 37, 39, 41, and 43, and is stacked in stacker 3 with the copied side upwards (process C). The above processes A to C are repeated until the designated number of copied sheets of paper are stacked in stacker 3.

Next, pickup roll 45 is lowered by means of the pickup solenoid, so that pickup roll 45 feeds the first paper P in stacker 3 to separating roll 47. Changeover gate 9 also changes over towards the side of discharge roll 49.

The leading end of paper P that is, thus, fed from stacker 3 reaches aligning roller 51, which is stationary, and is aligned by pressing against this roller 51 (process D). When aligning roller 51 starts to rotate, paper P is fed to aligning roller 17 of image forming unit 19, where it is aligned, and transfer is effected to the second side of paper P. Paper P is then separated from photosensitive body 21 (process E). After paper P has been separated from photosensitive body 21, fixing is performed on the second side of paper P. Paper P is then passed from discharge roller 31 through the top of changeover gate 9 and then through discharge roller 49, whence paper P is discharged to paper receiving tray 53 (process F). After completion of the above process E, the RADF feeds the next document D.

Thus, in the both-sides copying mode, as shown in FIG. 8, the time required to copy both sides (front and back) of a single-sheet document is 8.5 seconds and a time of $8.5/2=4.25$ seconds is required for copying of one side. In contrast, in single-side copying mode, in which only one side of paper P is copied, as shown by the time chart of FIG. 9, five copies are made in a period of 6.5 seconds. In this case, the time for copying one side is only $6.5/5=1.3$ seconds.

Thus, when the both-sides copying mode is employed, the copying time per side is longer than the case of single-side copying mode. Furthermore, the operating time of the image forming unit 19 becomes longer. This causes the following problems.

(1) Since the developer is stirred for a long time in the developing unit 55 deterioration of its developing characteristics due to oxidation of the developer is promoted. Furthermore, this protracted stirring increases the amount of splashing of developer to outside the developing unit 55, resulting in increased soiling of the area around this unit 55.

(2) At the periphery of photosensitive body 21, cleaning blade 59 of cleaning unit 57, which is always in contact with photosensitive body 21 while this body rotates during copying, is subjected to friction over a long period of time. This promotes wear of cleaning blade 59, and dulls its edge, adversely affecting its cleaning effect.

(3) Due to the friction between photosensitive body 21 and cleaning blade 59, local wear of photosensitive body 21 is increased, causing damage to photosensitive body 21 and deterioration in its performance.

(4) Regarding the fixing unit 29, wear of the heat roll 56 and cleaning felt 60, that cleans away dirt, is increased by protracted operation. This adversely affects the fixing function, and shortens the life, of these two components.

SUMMARY OF THE INVENTION

It is an object of the present invention to provide an image forming apparatus which can prevent inconveniences such as reduced life of the image forming means even when accessory units such as a reversible automatic document feeder and an automatic duplex device are employed.

According to the present invention there is provided an image forming apparatus including means for successively forming an image on each of the stacked image forming media respectively corresponding to a first image of a first document and a second image of a second document and means for idling the image forming means between the end of the first image forming operation for the first document and the commencement of the second image forming operation for the second document, the apparatus comprising means for supporting each of the documents; means for successively setting the first document and the second document onto the supporting means; means for detecting an operating condition which the setting means actuates to set the documents onto the supporting means; and means for prohibiting the operation of the idling means when the detecting means detects the operating condition.

DETAILED DESCRIPTION OF THE PREFERRED EMBODIMENT

Referring to the accompanying drawings, a detailed description will subsequently be given of the preferred embodiment of the present invention.

Figure 2:
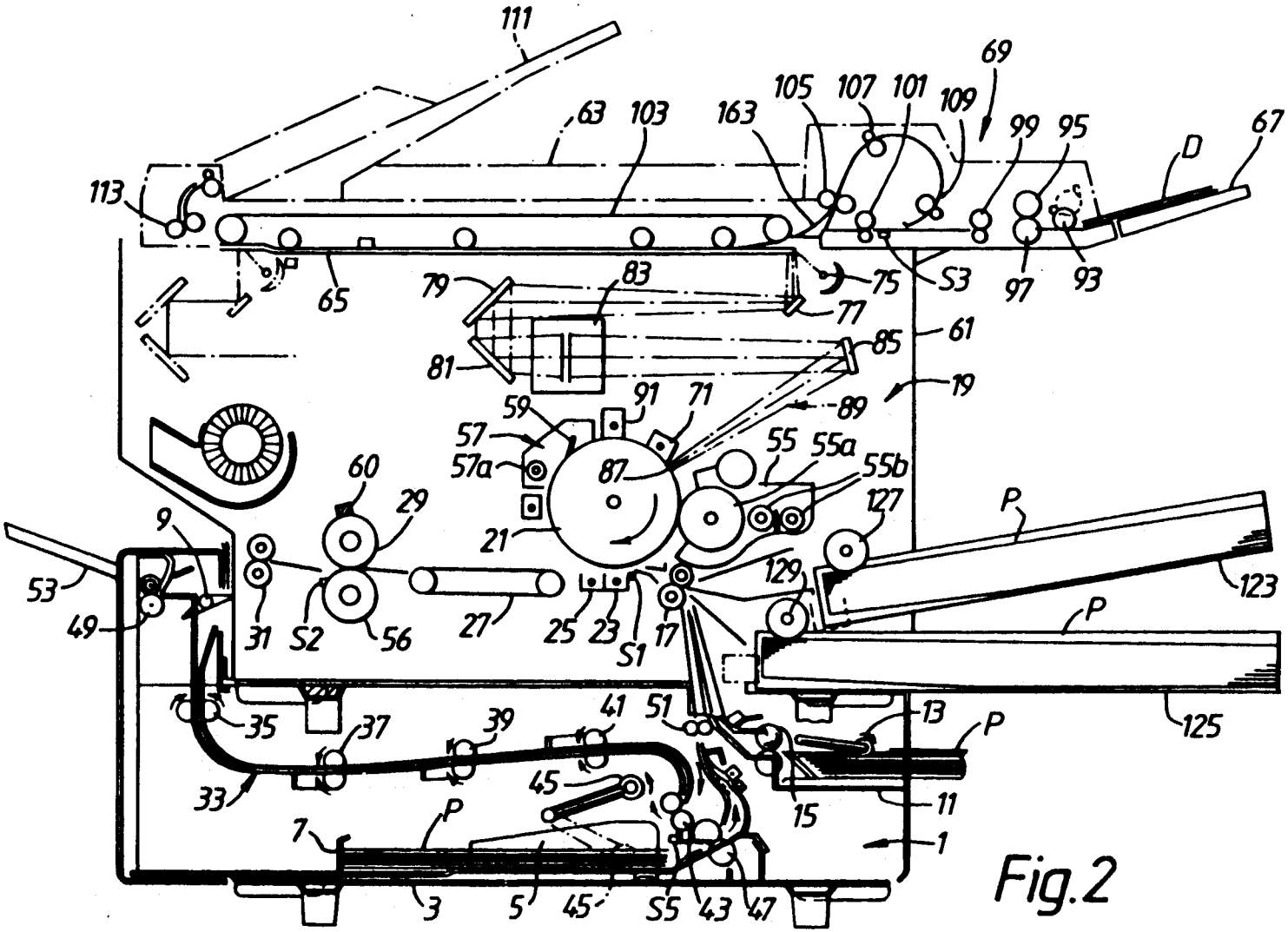
FIG. 2 is a cross-sectional view of a copying apparatus as an image forming apparatus according to the present invention.
Figure 3:
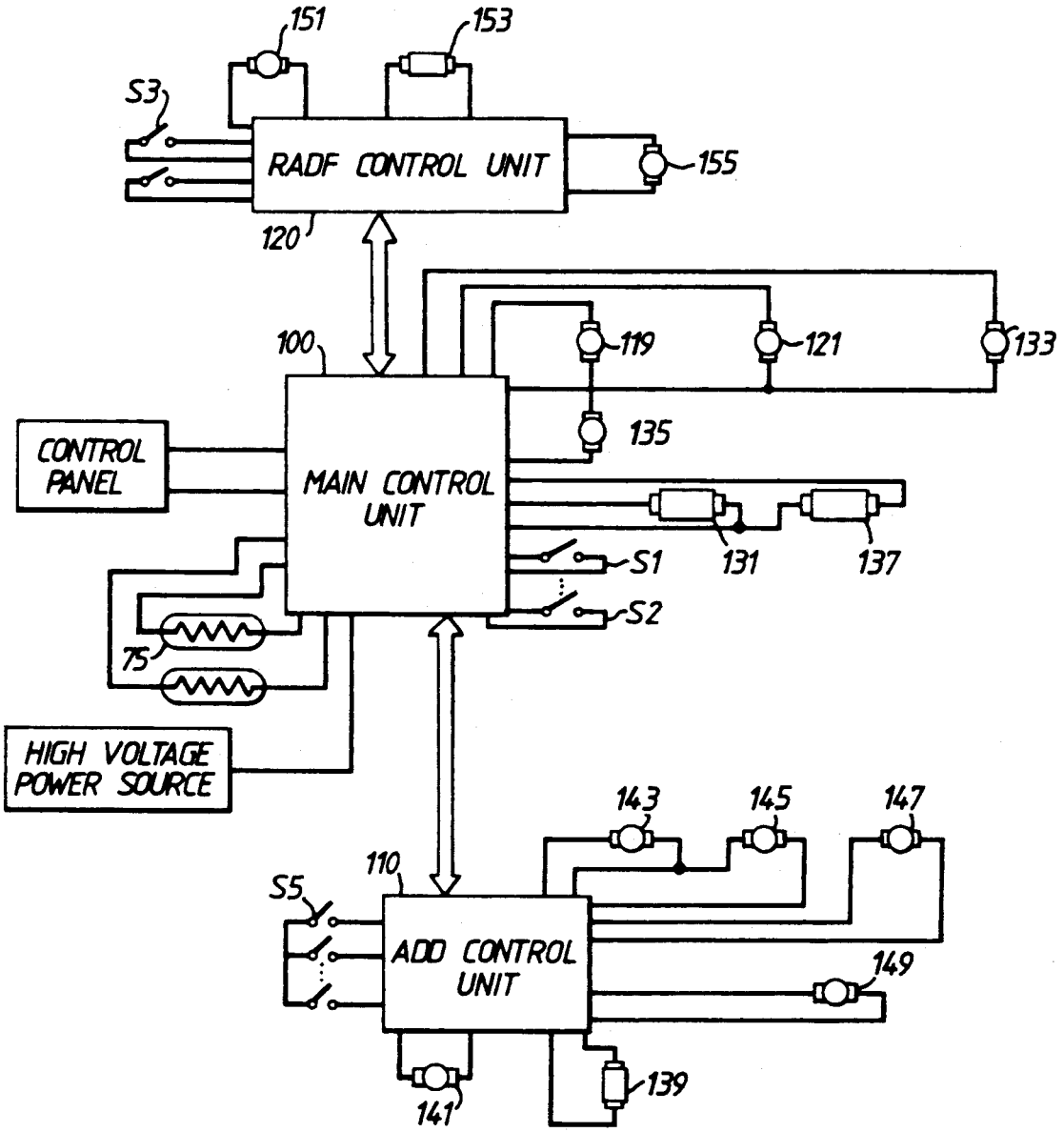
FIG. 3 is a block diagram showing the drive system of the copying apparatus.

As shown in FIG. 2, at the top of main body 61 constituting a copying apparatus as an image forming apparatus, platen cover 63 is pivotably mounted to be opened and closed. Platen glass 65 is also fitted at the top of main body 61. Furthermore, there is provided an accessory unit constituted by Reversible Automatic Document Feeder 69 (hereinbelow abbreviated as RADF) whereby document D that has been arranged on input tray 67 can be fed on to platen glass 65, and, after document D has been fed in and the first side has been copied, the document on platen glass 65 can be turned over so that its second side is arranged on platen glass 65.

Figure 7:
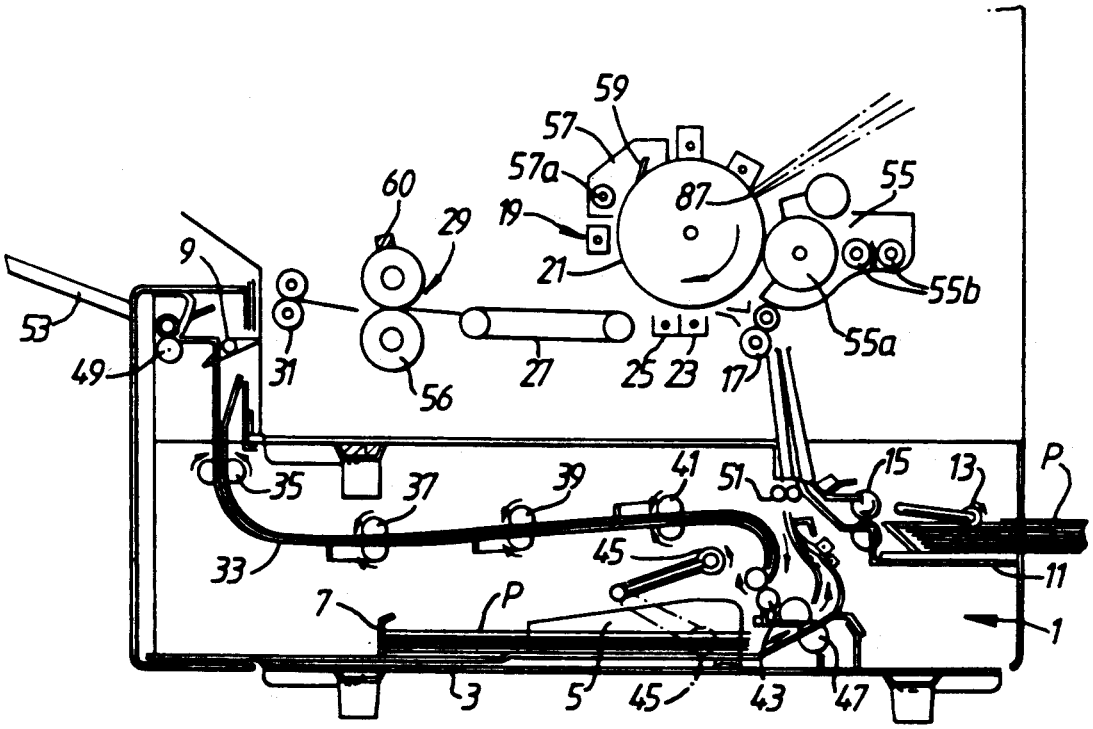
FIG. 7 is a cross-sectional view of the paper feed device.

Further an accessory unit is mounted at the bottom of main body 61. This accessory unit consists of a paper feed unit or an Automatic Duplex Device (hereinbelow abbreviated as ADD) 1 for performing copying onto both sides of paper P. Components of ADD 1 which are the same as those of FIG. 7 are given the same reference numerals, and any description of their construction is omitted.

Within main body 61 there is provided an image forming unit 19 constituting image forming means. Image forming unit 19 comprises photosensitive body 21, main charger 71, exposure device 89, developing unit 55, transfer charger 23, separating charger 25, cleaning unit 57, discharging unit 91, and fixing unit 29. Photosensitive body 21 is rotated in the direction indicated by the arrow. Main charger 71 electrostatically charges photosensitive body 21. In exposure device 89, the image of the document which is illuminated by exposure lamp 75 is deflected by mirrors 77, 79, 81, lens 83 and mirror 85 provided on a carriage (not shown), until it reaches an exposure unit 87. Developing unit 55 includes developing roller **55*a* which supplies toner to the surface of photosensitive body 21 and agitator 55*b* which mix toner powder and carrier particles. Toner powder separated from carrier particles is supplied by developing roller 55*a* to photosensitive body 21 to form a visible image by adhesion of toner powder to an electrostatic latent image on photosensitive body 21. Transfer charger 23 transfers the toner powder onto paper P which has been fed to photosensitive body 21 by alignment roll 17. Separating charger 25 separates the paper P from photosensitive body 21. Cleaning unit 57 scrapes off toner powder left on photosensitive body 21, using cleaning blade 59. Discharging unit 91 removes residual charges left behind on photosensitive body 21. Fixing unit 29 fixes the toner powder on paper P after it has been separated from photosensitive body 21, by heating the toner powder. This image forming unit 19, ADD 1 and RADF 69 are controlled by main control unit 100, shown in FIG. 1. RADF 69 is equipped with pickup roller 93, that extracts documents D piled on the input tray 67, feed roller 95 and separating roller 97 for extracting a single document D, aligning rollers 99 and 101 for aligning the edges of document D, conveyor belt 103 for setting document D on platen glass 65, or removing such document D after it has been set, inverting rolls 105, 107 and 109 for inverting such document D in conjunction with the operation of withdrawing document D, and paper discharge roll 113 that discharges document D on platen glass 65 to document receiving tray 111**.

Photosensitive body 21, developing roller **55*a* and agitator 55*b* of developing unit 55, and toner recovery auger 57*a* of cleaning unit 57 are driven by main motor 119. Heat rollers 56 of fixing unit 29 is driven by motor 121. Pickup rollers 127 and 129 of paper cassettes 123 and 125 are raised and lowered by pickup solenoid 131 and driven by paper feed motor 133. Aligning roller 17 is driven by aligner motor 135. Changeover gate 9 is changed over by changeover solenoid 137. These various motors and solenoid are controlled by main control unit 100**.

Regarding ADD 1, pickup roller 45 is raised and lowered by pickup solenoid 139 and driven to rotate by feed motor 141. Feed rollers 35, 37, 39, 41 and 43 are driven by conveyor motor 143. Separating roller 47 is driven by aligner motor 145. Paper side guide 5 is driven by paper side moving motor 147. Paper rear end guide 7 is driven by paper rear end moving motor 149. These various motors and solenoid are controlled by ADD control unit 110.

Regarding RADF 69, aligning rollers 99 and 101 are driven by aligner motor 151. Pickup roller 93 is raised and lowered by pickup solenoid 153. Feed belt 103 and inverting rolls 105, 107 and 109 are driven by invertor motor 155. These various motors and solenoid are controlled by RADF control unit 120.

ADD control unit 110 and RADF control unit 120 are controlled through an interface by main control unit 100.

An operating condition detection means 200 detects the operating state of the accessory units of image forming unit 19, mainly, ADD 1 and RADF 69. And main control unit 100 is arranged so that, based on the detection output of this operating condition detection means 200, main control unit 100 outputs a command to image forming unit 19 that interrupts part or all of the copying processes during operation of the accessory units.

Figure 1:
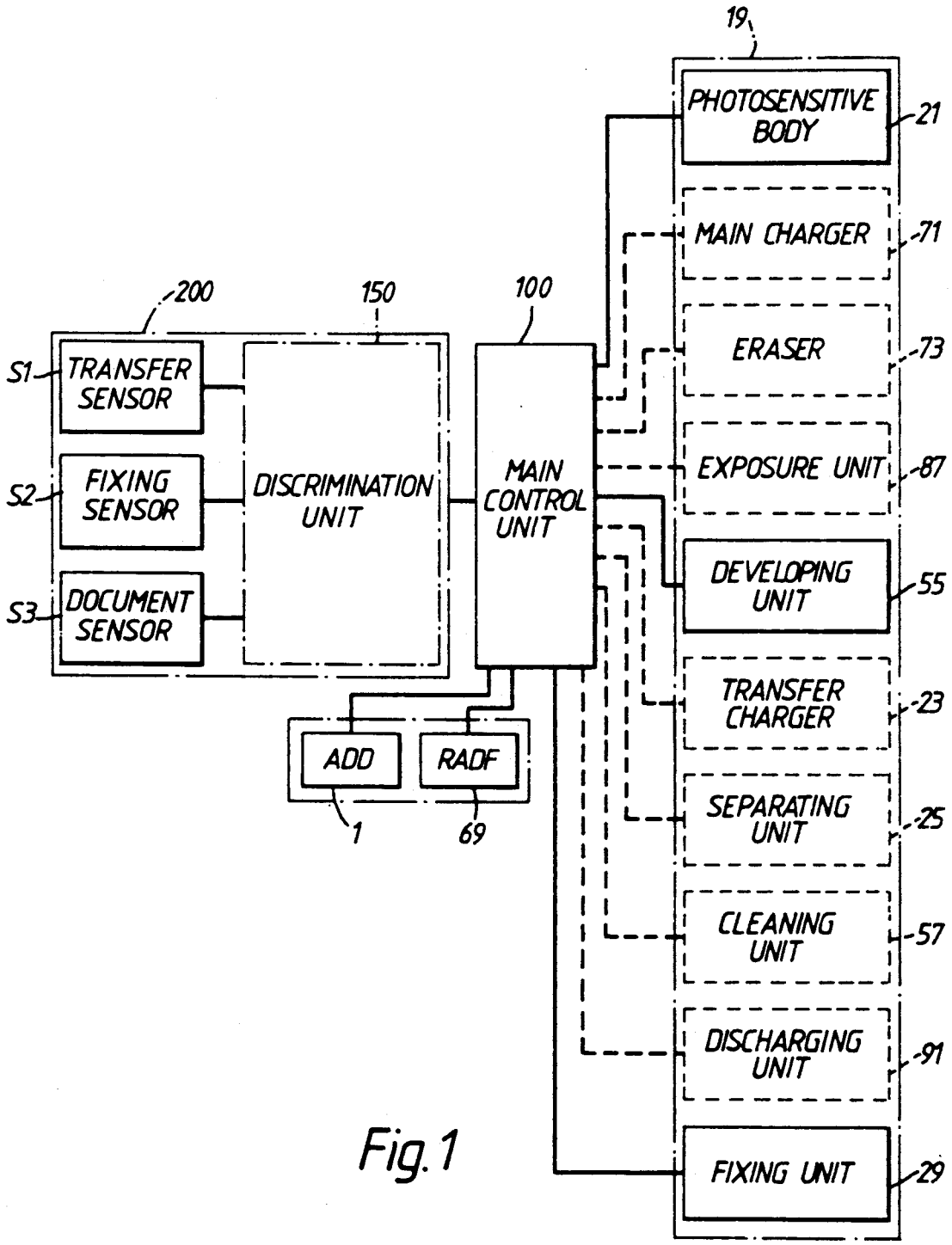
FIG. 1 is a block diagram showing an embodiment of the present invention.

Operating state detection means 200 is equipped with: transfer sensor S1 arranged close to transfer charger 23 and that performs a detection operation when the rear end of paper P passes this transfer charger 23; fixing sensor S2 arranged close to heat roller 56 of fixing unit 29 that performs a detection operation when the rear end of paper P passes this heat roll 56; and document sensor S3 provided in RADF 69 and that performs a detection operation when the inversion operation of document D has been completed. Operating state detection means 200 is also equipped with discrimination unit 150, as shown in FIG. 1, having the function of discrminating the passage through transfer charger 23 of the last paper of the designated number of copying sheets of paper P, for example by counting the number of detections made by transfer sensor S1, and that is equipped with the function of discriminating when said last paper passes through heat roll 56, for example by counting the number of times of detection of fixing sensor S2.

Next, the operation of main control unit 100 in commanding the interruption of the copying processes of image forming unit 19, comprising photosensitive body 21 etc., in accordance with the detection output of these various sensors S1 to S3 and discrimination unit 150 will now be described with reference to the flow carts shown in FIG. 4 to FIG. 6.

Figure 4:
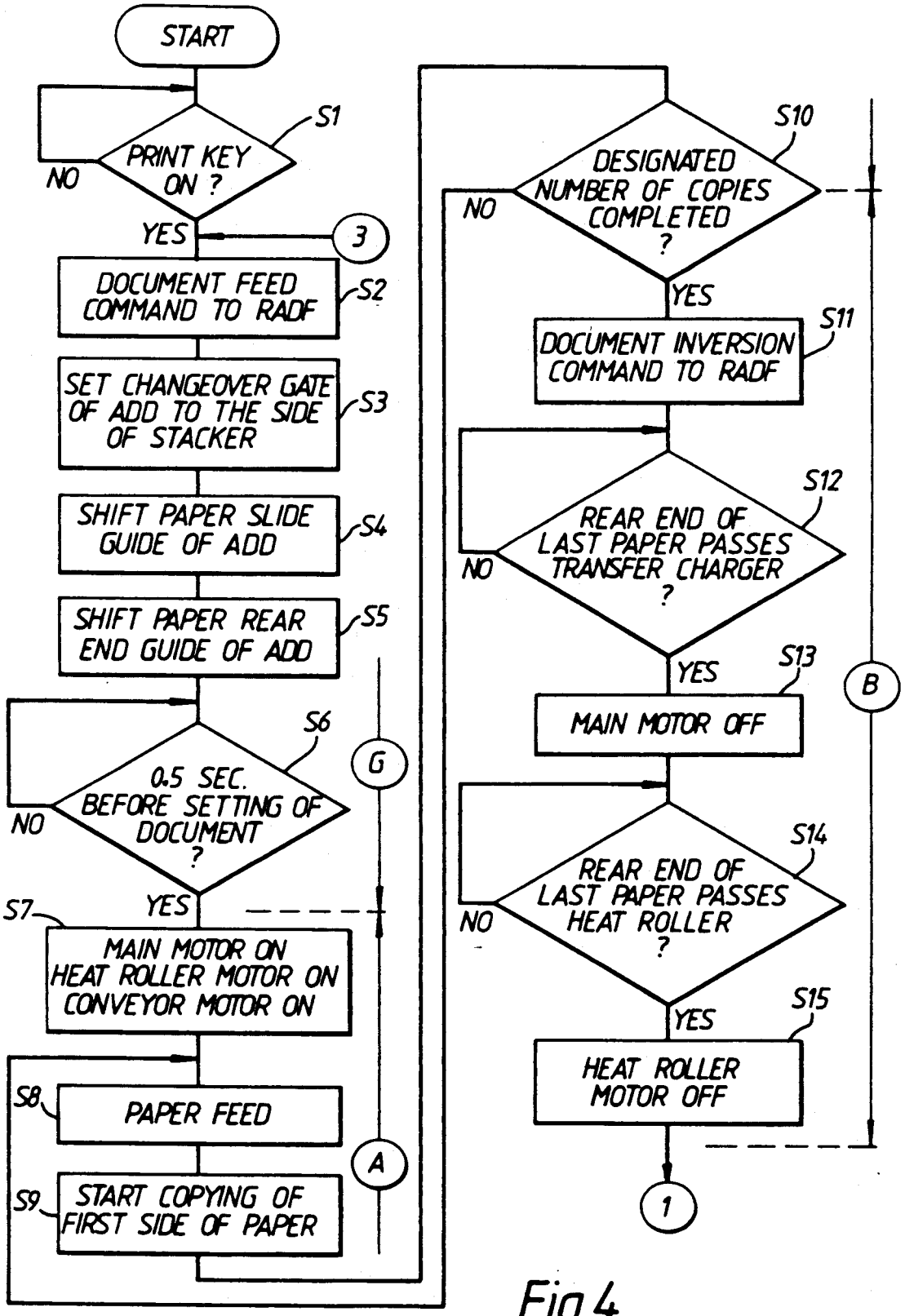
FIGS. 4, 5 and 6 are flow charts showing the operation of the copying apparatus of the present invention.
Figure 5:
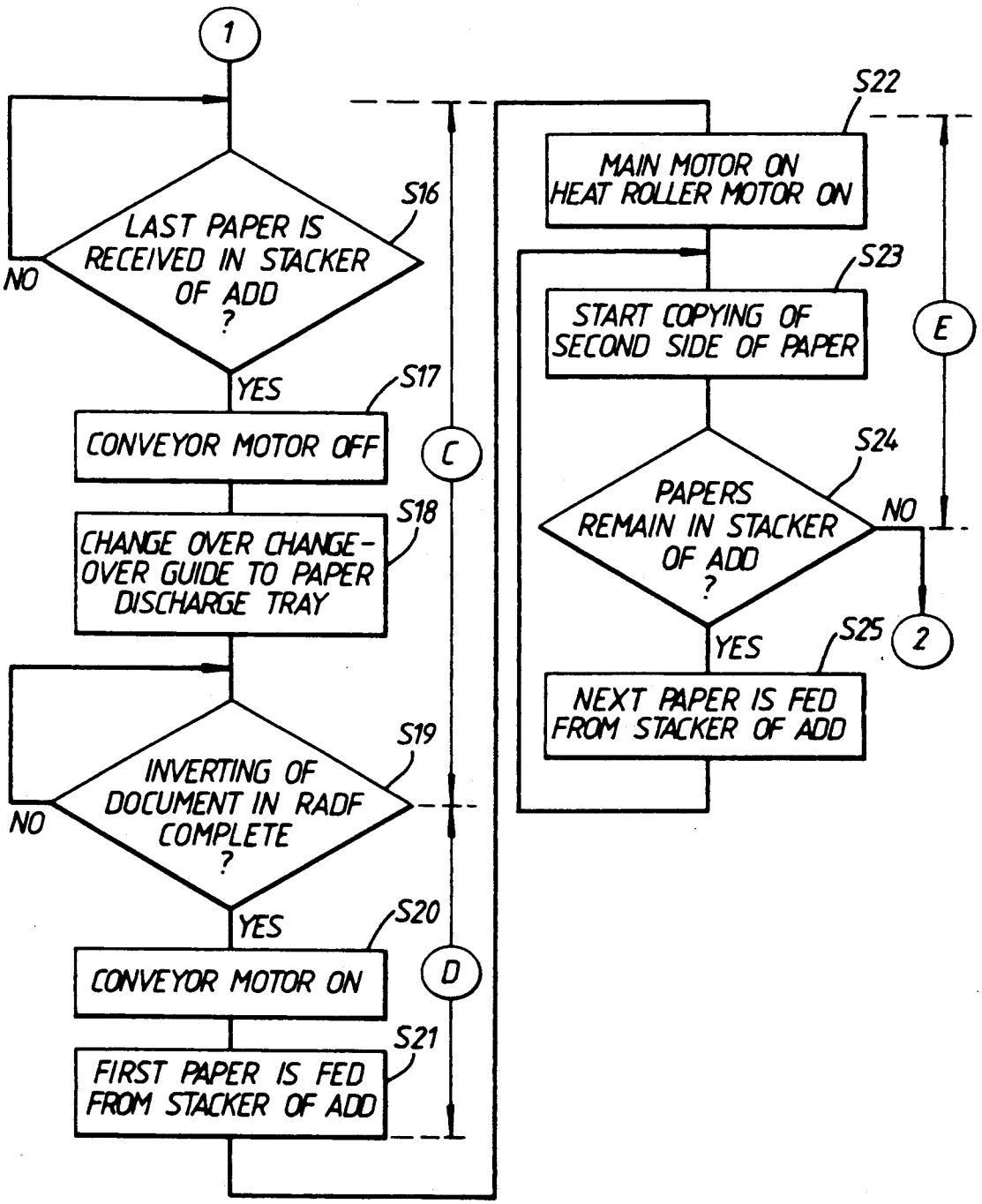
Figure 6:
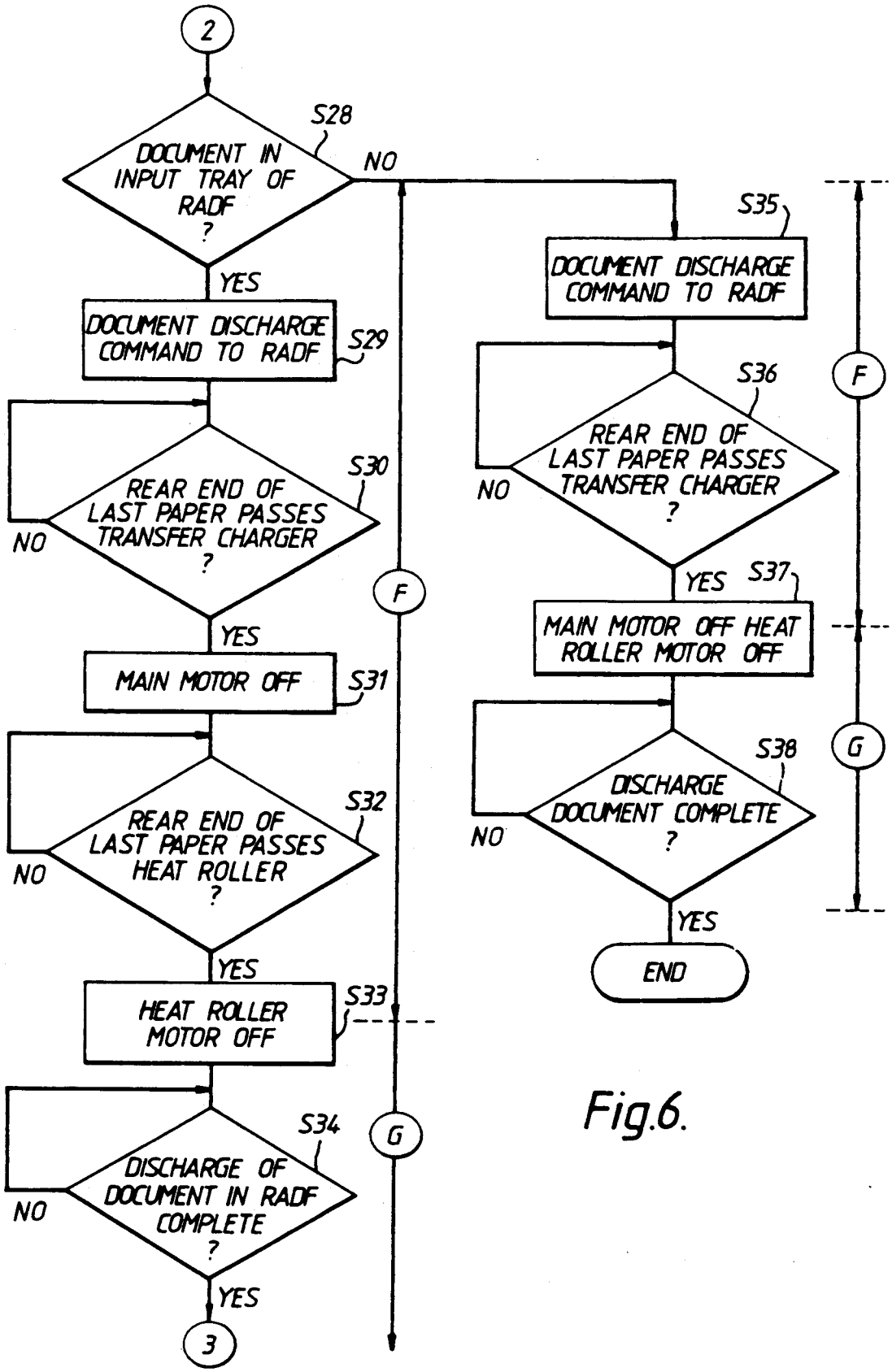

FIG. 4 to FIG. 6 are flow charts for an embodiment in which ADD 1 is the main accessory unit.

When the print key is pressed (step S1) to perform the copy operation in a condition in which document D is set on input tray 67 and the both-sides copying mode is employed, a document feed command is output by RADF control unit 120 (step S2) causing changeover gate 9 to be set to the side of stacker 3 (step S3), shifting paper side guide 5 in accordance with the size of paper P (step S4) and shifting paper rear end guide 7 too (step S5).

About 0.5 seconds before setting of document D onto platen glass 65 has been completed (step S6), all of main motor 119, heat roll motor 121, and conveyor motor 143 start to rotate. By the rotation of main motor 119, photosensitive body 21, developing roller 55*a* and agitator 55*b* of developing unit 55, and toner recovery auger 57*a* of cleaning unit 57 are driven. By the rotation of heat roller motor 121, heat roller 56 of fixing unit 29 is driven. By the rotation of conveyor motor 143, conveyor rollers 35, 37, 39, 41 and 43 of stack conveyor path 33 are driven (step S7).

Next, one of the pickup rolls 127 and 129 of paper cassettes 123 and 125 is lowered and is driven in rotation, so that one sheet of paper P at a time is fed to transfer charger 23 (step S8), and passes through separating charger 25 and fixing unit 29, thereby performing copying of the first side of the paper P (step S9).

When the designated number of copies has been completed (step S10), RADF 69 issues a document inversion command (step S11). In response to this, RADF control unit 120 causes inverter motor 155 to rotate in reverse, so that feed belt 103 returns document D on platen glass 65 towards inverting gate 163. The returned document D is guided by inverting guide 163 and is then successively fed by inverting rolls 105, 107 and 109, through aligning roller 101, and then set on platen glass 65 with its second side facing downwards, by means of feed belt 103, which has commenced the forward feed operation.

When the rear end of the last paper P of the designated number of sheets of paper P in copying the first side has passed transfer charger 23 (step S12), in response to a decision by discrimination unit 150 in response to the detection action of transfer sensor S1, main control unit 100 commands cessation of drive of main motor 119 (step S13), and stopping all of the photosensitive body 21, developing unit 55, and cleaning unit 57.

Next, when the rear end of this last paper P passes heat roller 56 (step S14) by a decision made by discrimination unit 150 in response to detection operation by fixing sensor S2, heat roller motor 121 is stopped (step S15). After side one of document D has been copied on to paper P, the paper P passes under changeover gate 9, passing through stack conveyor path 33, and is received in stacker 3 with the side on to which the copy has been made facing upwards.

When the discrimination unit decides (step S16), by means of the detection action of sensor S5 arranged for example close to conveyor roller 43, that the specified number of sheets of paper P have been received in stacker 3, in response to this, conveyor motor 143 is stopped and conveyor motors 35, 37, 39 and 41 are stopped (step S17), and changeover gate 9 is changed over to paper receiving tray 53 (step S18).

Next, when it is decided that the inverting operation of document D has been completed (step S19), conveyor motor 143 is again driven (step S20). In the ADD 1, feed motor 141, pickup solenoid 139, and aligner motor 145 are also driven, causing pickup roller 45 to be lowered and driven. As a result, paper P in stacker 3 is fed out (step S21). The paper P that is fed out is supplied through separating roll 47 to aligning roll 51, whence the paper P is fed from aligning roll 17 of image forming unit 19 to transfer charger 23. Main motor 119 and heat roller motor 121 are then driven (step S22), so that paper P passes from transfer charger 23 to separating charger 25 and fixing unit 29, copying thereby being effected on to its second side (step S23). After the copying has been completed, paper P is discharged to paper receiving tray 53 through discharge roll 31 and the top of changeover gate 9.

This operation of copying of the second side continues as long as there is paper P left in the stacker 3 (steps S24 and S25). When the paper P in the stacker 3 runs out, the apparatus decides (step S28) whether there is any remaining document D in the input tray 67 of RADF 69. If there is still document D in input tray 67, RADF control unit 120 issues a document discharge command (step S29). When the last paper P of the designated number of sheets of paper P for second-side copying has passed transfer sensor S1 (step S30), main motor 119 is stopped (step S31), and photosensitive body 21, developing roller 55*a* and agitator 55*b* of developing unit 55, and toner recovery auger 57*a* of cleaning unit 57 are also stopped. Also, when this last paper P has completed its passage past fixing sensor S2 (step S32), heat roll motor 121 is also stopped (step S33). When the discharge of document D to document receiving tray 111 of RADF 69 has been completed (step S34), control returns to step S2 of FIG. 4, to prepare for copying of a next document.

It may happen that document D is left on platen glass 65 in step S28 when no document D is left in the input tray. If this happens, RADF control unit 120 likewise issues a document discharge command (step S35). In this case, when the last paper P of the designated number of sheets of paper P has passed heat roll 56 (step S36), in response to a decision by discrimination unit 150 resulting from the detection action of fixing sensor S2, main motor 119 and heat roll motor 121 are stopped (step S37). When the discharge of document D to document receiving tray 111 has been completed (step S38), the copying operation is terminated.

In the above control operation, main motor 119 is temporarily stopped for the duration of processes B, C, and D after the last of the designated number of sheets of paper P has passed transfer charger 23 in the process of copying the first side of documents D on to sheets of paper P in steps S13 to S21 of the flow charts of FIG. 4 to FIG. 6, up until step S21, in which paper feed operation for copying of the second side is commenced. Photosensitive body 21, developing unit 55 and the cleaning blade 59 of cleaning unit 57 are therefore temporarily halted. As a result, wear of cleaning blade 59 and photosensitive body 21 are reduced, and the deterioration of the cleaning function and deterioration of performance of photosensitive body 21 are reduced. Furthermore, the time during which the developer is stirred is shortened, thus reducing deterioration of the developer and the amount of splashing outside of the developing unit 55, and preventing soiling of the area around the developing unit 55.

Furthermore, after step S14, in which the last paper P passes heat roll 56 and up to step S21, in which paper feed operation for copying of the second side of paper P commences, heat roll motor 121 is temporarily stopped for the duration of the latter half of process B, and processes C and D. Wear of heat roller 56, and the cleaning felt 60 used to clean it, are thereby reduced, and the loss of fixing function is reduced.

Also, since the temporary halt of main motor 119 and heat roll motor 121 continues for the duration of the latter half of process F and process G respectively indicated in steps S31 to S7 and steps S33 to S7, the benefit of reduction in wear and deterioration of photosensitive body 21 etc. is obtained in the same way as in the case of processes B, C and D described above.

Figure 8:
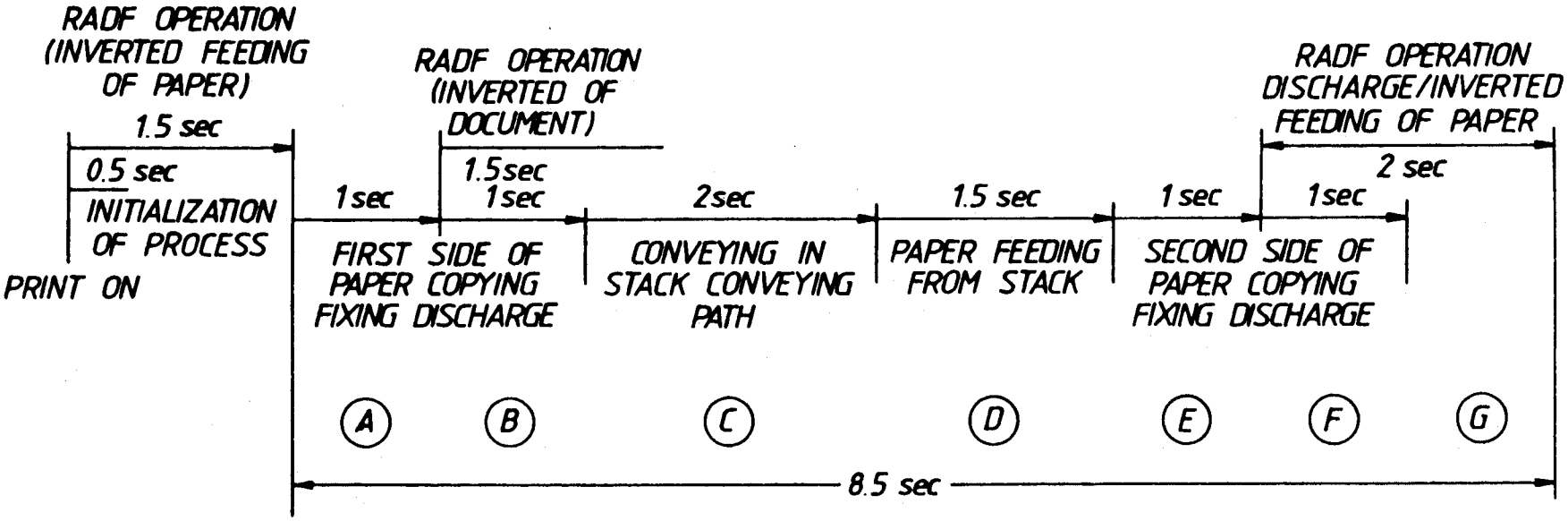
FIG. 8 is a time chart of the both-sides copying operation.
Figure 9:
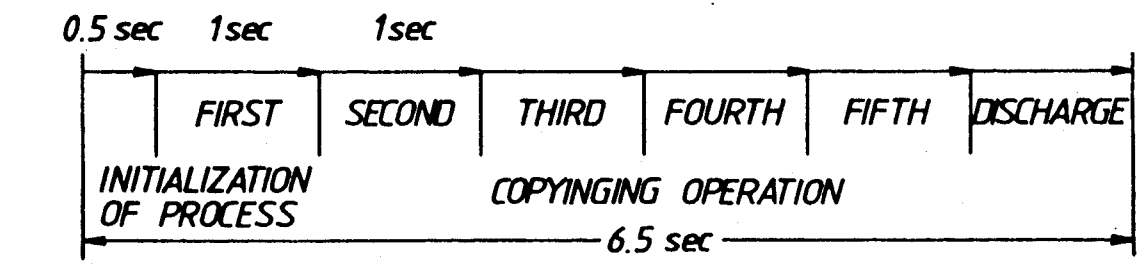
FIG. 9 is a time chart of the one-side copying operation.

Consider the time of the interruption of main motor 119. From the time chart of FIG. 8, the interrupted part of copying process B and processes C and D occupy about 3.5 seconds. Process G takes about 0.5 seconds. Thus, whereas conventionally about 8 seconds operation of photosensitive body 21 and developing unit 55 occurred in order to perform both-sides copying as shown in FIG. 8, with this embodiment, operation is needed for only about 4 seconds. Thus, the problems of the prior art are greatly alleviated in that wear and deterioration of performance of photosensitive body 21 as described above are limited.

An embodiment was described above in which the main accessory unit was a paper feed unit or an automatic duplex device (ADD) for both-sides copying, the copying process being interrupted in accordance with the operating condition of this accessory unit.

As many apparently widely different embodiments of the present invention may be made without departing from the spirit and scope thereof, it is to be understood that the present invention is not limited to the specific embodiments therof except as defined in the appended claims.

What is claimed is:

1. An image forming apparatus comprising:

a main body having a platen to support a document;

means in the main body for forming an image of the document on an image forming medium;

a document feed unit for feeding the document onto the platen and inverting the front and back of the document; and means for controlling the image forming means to interrupt operation of part or all of the image forming means during the time the document feed unit feeds the document onto the platen or the feed unit inverts the document.

2. The apparatus of claim 1 wherein the image forming means includes an image carrier on which the image is formed, means for driving the image carrier, means for developing the image on the image carrier to form a visible image on the image carrier, means for transferring the visible image from the image carrier onto the image forming meidum, and means for fixing the visible image on the image forming medium, wherein the controlling means controls at least one of the driving means, the developing means, the transferring means, and fixing means to interrupt the operation thereof.

3. An image forming apparatus comprising:

a main body;

means in the main body for forming an image on an image forming medium;

a paper feed unit for inverting the front and back of the image forming medium which has been fed from the image forming means and refeeding the image forming medium toward the image forming means;

means for detecting the time during which the image forming medium is fed to the paper feed unit from the image forming means, the time during which the feed unit inverts the image forming medium and the time during which the paper feed unit refeeds the image forming medium toward the image forming means, and outputting a detecting signal; and means for controlling the image forming means to interrupt operation of part or all of the image forming means in response to the detecting signal from the detecting means.

4. The apparatus of claim 3 wherein the image forming means includes an image carrier on which the image is formed, means for driving the image carrier, means for developing the image on the image carrier to form a visible image on the image carrier, means for transferring the visible image from the image carrier onto the image forming meidum, and means for fixing the visible image transferred from the image carrier onto the image forming medium, wherein the controlling means controls at least one of the driving means, the developing means and fixing means, to interrupt the operation thereof.

5. An image forming apparatus comprising:

a main body;

means in the main body for forming an image on an image forming medium;

a document feed unit for feeding a document onto the main body and inverting the front and back of the document;

means for detecting the time the document feed unit feeds the document onto the platen or the feed unit inverts the document and outputs a detecting signal; and means for controlling the image forming means to interrupt operation of part or all of the image forming means in response to the detecting signal from the detecting means.

6. An image forming apparatus comprising:

means for supporting a document having an image thereon;

means for successively setting a first document and a second document onto the supporting means;

means for successively forming an image on each of the image forming media respectively in accordance with the image on the first and second documents set by the setting means on the supporting means;

means for idling the image forming means during the time between the end of the first image forming operation for the first document and the commencement of the second image forming operation for the second document; and means for prohibiting the operation of the idling means during the time between the commencement of the discharging the first document from the supporting means and the end of the setting the second document onto the supporting means.

7. The apparatus of claim 6 wherein the image forming means includes an image carrier on which the image is formed and means for driving the image carrier.

8. The apparatus of claim 6 wherein the image forming means includes an image carrier on which the image is formed, and means for developing the image on the image carrier to form a visible image on the image carrier, the developing means including means for supplying developer to the image carrier and means for agitating the developer.

9. The apparatus of claim 6 wherein the image forming means includes means for attaching a visible image on the image forming medium end for fixing the visible image on the image forming medium.

10. The apparatus of claim 8 wherein the image forming means further includes means contacting the surface of the image carrier, for removing the developer from the image carrier to clean the surface of the image carrier.

11. An image forming apparatus comprising:

means for forming a first image on an image forming medium and a second image on the image forming medium;

means for discharging the image forming medium on which the first image has been formed from the image forming means;

means for temporarily stacking the image forming medium on which the first image has been formed;

means for transporting the image forming medium from the discharging means to the stacking means;

means for refeeding the image forming medium from the stacking means to the image forming means, so as to form the second image on the image forming medium;

means for idling the image forming means during the time between the end of the forming operation of the first image and commencement of the forming operation of the second image; and means for prohibiting the operation of the idling means during the time the image forming medium is transported by the transporting means from the discharging means to the stacking means.

12. The apparatus of claim 11 wherein the image forming means includes an image carrier on which the image is formed and means for driving the image carrier.

13. The apparatus of claim 11 wherein the image forming means includes an image carrier on which the image is formed, and means for developing the image on the image carrier to form a visible image on the image carrier, the developing means including means for supplying developer to the image carrier and means for agitating the developer.

14. The apparatus of claim 11, wherein the image forming means includes means for attracting a visible image to the image forming medium and for fixing the visible image on the image forming medium.

15. The apparatus of claim 13, wherein the image forming means further includes means, contacting the surface of the image carrier for removing the developer from the image carrier to clean the surface of the image carrier.

* * * * *